US008154573B2

(12) United States Patent
Shinohara et al.

(10) Patent No.: US 8,154,573 B2
(45) Date of Patent: Apr. 10, 2012

(54) METHOD OF FORMING A LATENT IMAGE ON AN OVERCOAT LAYER

(75) Inventors: Satoru Shinohara, Miyagi (JP); Masanobu Hida, Miyagi (JP)

(73) Assignee: Sony Corporation, Tokyo (JP)

( * ) Notice: Subject to any disclaimer, the term of this patent is extended or adjusted under 35 U.S.C. 154(b) by 601 days.

(21) Appl. No.: 12/329,855

(22) Filed: Dec. 8, 2008

(65) Prior Publication Data

US 2009/0153639 A1 Jun. 18, 2009

(30) Foreign Application Priority Data

Dec. 13, 2007 (JP) ..... 2007-322563

(51) Int. Cl.
*B41J 2/00* (2006.01)

(52) U.S. Cl. ..... 347/190; 347/191; 427/145

(58) Field of Classification Search ..... 347/171, 347/188, 190, 191, 194; 427/145
See application file for complete search history.

(56) References Cited

U.S. PATENT DOCUMENTS

| | | | | |
|---|---|---|---|---|
| 5,267,755 | A * | 12/1993 | Yamauchi et al. | 283/86 |
| 6,369,919 | B1 * | 4/2002 | Drinkwater et al. | 359/2 |
| 6,984,424 | B2 * | 1/2006 | Suzuki et al. | 428/32.63 |
| 7,738,173 | B2 * | 6/2010 | Schilling et al. | 359/573 |

FOREIGN PATENT DOCUMENTS

| | | | |
|---|---|---|---|
| JP | 53-28443 | | 3/1978 |
| JP | 2000-280663 | | 10/2000 |
| JP | 2001-144944 | | 5/2001 |
| JP | 2004276560 | A * | 10/2004 |
| JP | 2005-043778 | | 2/2005 |
| JP | 2007237416 | A * | 9/2007 |

* cited by examiner

*Primary Examiner* — Daniel Petkovsek
(74) *Attorney, Agent, or Firm* — SNR Denton US LLP

(57) ABSTRACT

A method of forming a latent image portion on an overcoat layer by a difference in surface brilliance, at the time of layering an overcoat layer on a thermal transfer subject sheet by a heat transfer method, includes the steps of: setting at least two types of applied energy from the thermal head wherein a plurality of thermal elements are arrayed in line form, and layering the overcoat layer on the thermal transfer subject sheet; forming a difference in surface brilliance made up of a region of relatively high degree of brilliance and a region of relatively low degree of brilliance, based on the difference in the applied energy, to form a line pattern with a plurality of lines; and forming the lines by shifting a phase of a line pattern of the latent image portion and the line pattern of a background portion excluding the latent image portion.

10 Claims, 10 Drawing Sheets

METHOD OF FORMING A LATENT IMAGE ON AN OVERCOAT LAYER

CROSS REFERENCES TO RELATED APPLICATIONS

The present invention contains subject matter related to Japanese Patent Application JP 2007-322563 filed in the Japanese Patent Office on Dec. 13, 2007, the entire contents of which are incorporated herein by reference.

BACKGROUND OF THE INVENTION

1. Field of the Invention

The present invention relates to a latent image forming method to form a background and latent image with surface brilliance difference of the surface of an overcoat layer in the event of layering an overcoat layer onto an image with a thermo-sensitive transfer method (thermal transfer method), a printer device to which this latent image forming method is applied, a visualizing method to visualize the latent image as a line moiré by observing the latent image through a visualizing tool having lines of similar pitch as the above-mentioned lines, and a visualizing tool employed for the visualizing method.

2. Description of the Related Art

With a technique according to related art, a visualizing method forms a line pattern by printing, an image which is targeted as a latent image is hidden therein, and a visualizing tool having a line pattern with a similar pitch is provided as a transparent substrate (e.g. see Japanese Unexamined Patent Application Publication No. 53-028443 and Japanese Unexamined Patent Application Publication No. 2005-043778). These techniques are employed primarily for (1) authenticity determination of stocks and bonds (predetermined information is embedded as a latent image in the same image) and (2) authenticity determination of a document copy and an original document (a phenomenon that the lines may not be accurately reproduced in the event of a copy is used) and so forth. However, in order to hide the latent image within the image, the latent image portion and the background portion thereof should be images having roughly similar high uniformity in density, and design constraints have also occurred, causing difficulty in applying to a full-color image such as a photograph.

Also, a method to determine the authenticity by similarly employing moiré with a digital printer is disclosed in Japanese Unexamined Patent Application Publication No. 2000-280663 and Japanese Unexamined Patent Application Publication No. 2001-144944. With both the Japanese Unexamined Patent Application Publication No. 2000-280663 and Japanese Unexamined Patent Application Publication No. 2001-144944, a background and latent image are made up of lines or halftone dots, and the latent image is visualized by employing a visualizing tool whereby a moiré pattern appears, but design constraints have also occurred. With the Japanese Unexamined Patent Application Publication No. 2000-280663 a dye sublimation thermal transfer method is employed, but a determining region with moiré is provided separate from the photograph image.

In recent years, as various types of data have become electronic and information has become digitized, various techniques have been considered for electronic signatures or digital watermarking wherein information relating to copyright and other attribute information is added as invisible information to digital information. One example of such a technique is a method called an image deep layer signal. This technique embeds added information into primary image information as invisible information, and is effective in preventing replicating or tampering of image information having a copyright such as photographs, or securities and various types of cash vouchers.

SUMMARY OF THE INVENTION

Also, output images with the dye sublimation thermal transfer method have recently become suddenly prevalent as a printing method for silver halide photography because of the immediacy and image quality thereof. However, the dye sublimation thermal transfer method differs from a printing method having freedom of dot resolution, line pitch, and screen angle of halftone dots, and has little freedom in the case of embedding added information at the time of output of a photographic image as a latent image within such image. Normally, the latent image portion with a line pattern is formed as an image having roughly similar high uniformity in density as the line base portion thereof. Accordingly, in order to secure the image security with invisible added information, there is little choice but to provide an information embedding region outside of the photographic image, and this can become an obstacle or a design constraint.

There has been recognized demand to provide a latent image forming method which enables forming printed material having a latent image with lines, a printing device to which this latent image forming method is applied, a visualizing method to visualize the latent image, and a visualizing tool employed for the visualizing method, while increasing design freedom without providing constraints to the image forming region, such as enabling forming a photographic image over the entire surface with a thermal transfer method.

The present invention provides a latent image forming method to form a line pattern in a latent image on an overcoat layer, by employing contrast (surface brilliance difference) which occurs by controlling the heat energy applied with the thermal head in the event of layering an overcoat layer on the surface of an image recording medium with a thermo-sensitive transfer method (thermal transfer method), and a printer device to which the latent image forming method is applied. Also, the present invention provides a visualizing method to visualize the latent image through a visualizing tool wherein a line pattern of a pitch roughly the same as the latent image of the overcoat layer is formed on a transparent substrate, and a visualizing tool employed for this visualizing method.

That is to say, the method of forming a latent image on the overcoat layer according to the present invention is a method of forming a latent image on the overcoat layer whereby a latent image portion is formed on the overcoat layer by surface brilliance difference in the event of layering an overcoat layer on a thermal transfer subject sheet with a thermal transfer method, and in the event of layering the overcoat layer onto the thermal transfer subject sheet by thermal transfer, the applied energy from the thermal head wherein multiple thermal elements are arrayed in line form are set as at least two types, and from the difference in applied energy, the surface brilliance difference made up of a region of relatively high degree of brilliance and a region of relatively low degree of brilliance is formed, whereby a line pattern is formed with multiple lines, and in the event of forming the line patterns, the phase of the line pattern of the latent image portion and the line pattern of the background portion excluding the latent image portion is shifted to form the line pattern.

The printer device according to an embodiment of the present invention includes a thermal transfer subject sheet running unit configured to run a thermal transfer subject sheet; a thermal transfer sheet running unit configured to run a thermal transfer sheet on which at least an overcoat layer is formed by heat transfer on the thermal transfer subject sheet; a thermal head whereupon a plurality of thermal elements are arrayed in line form in a direction orthogonal as to the running direction of the thermal transfer subject sheet; and a control unit configured to drive and control the thermal head; wherein the control unit performs control of applied energy of the thermal head in at least two types, such that, in the event of performing heat transfer to layer the overcoat layer on the heat transfer subject sheet, a difference in surface brilliance which is made up of a region of relatively high degree of brilliance and a region of relatively low degree of brilliance is formed on the overcoat layer, based on the difference in applied energy as to the overcoat layer of the thermal head, a line pattern is formed with a plurality of lines, and in the event of forming the line pattern, the lines are formed by shifting a phase of a line pattern of the latent image portion and the line pattern of a background portion excluding the latent image portion.

The visualizing method of the latent image portion according to the present invention is a visualizing method to visualize latent image portion on the overcoat layer formed on the overcoat layer with the latent image forming method, wherein a visualizing tool is employed which forms a line pattern having the same pitch as the line pattern of the latent image portion formed on the overcoat later on a transparent substrate, the transparent substrate is disposed on the upper portion of the latent image portion, and the latent image portion is observed via the transparent substrate whereby a line moiré occurs, thus the latent image portion is visualized.

Also, the visualizing tool according to the present invention is a visualizing tool which visualizes the latent image portion on the overcoat layer formed with the latent image forming method on the overcoat layer, wherein a line pattern having the same pitch as the line pattern formed on the overcoat layer is formed on the transparent substrate.

The present invention enables a latent image to visualized with a line moiré which occurs with interference between a latent image line pattern formed with surface brilliance difference (contrast) on the overcoat layer and a line pattern provided on the transparent substrate. According to the present invention, a line pattern is formed on an overcoat layer having a high light transparency which is layered on a thermal transfer subject sheet and a latent image is provided, whereby latent image data such as date or time, individual identifying symbols or numbers, a name of an individual, or predetermined symbols and so forth can be provided as a latent image, without depending on an image positioned in an underlayer, e.g. on a photographic image. Particularly, the formed latent image is difficult to be visibly confirmed from a position directly facing the image, and depending on the processing of the lines in a border region between the latent image and the background portion excluding the latent image, some information may be extremely difficult to visibly confirm even in a state of observing the image at an angle. This latent image can be visualized with a visualizing tool having lines with a roughly similar pitch as the lines provided on the overcoat layer on the transparent substrate.

Accordingly, with the present invention, a latent image can be provided on an image without losing the image formed on an arbitrary thermal transfer subject sheet, and without restricting the design and so forth of the image formation. According to the present invention, design freedom is further increased, while a printed material having high security wherein the latent image cannot be visually confirmed readily can be obtained.

Also, with the present invention, a latent image with light transparency is embedded in the overcoat layer provided independent from the layer on which the image is recorded, whereby restrictions accompanied by embedding the latent image into a region forming the image, whereby image quality or design of the printed material is sacrificed as with the related art, can be prevented. The latent image formed with the present invention has light transparency, thereby is difficult to visually confirm, and can prevent observation of the image positioned under the overcoat layer being influenced.

DESCRIPTION OF THE PREFERRED EMBODIMENTS

A method for forming a latent image on an overcoat layer, visualizing method for this latent image, and a printer device and visualizing tool for forming the latent image, to which the present invention has been applied, will be described with reference to the appended drawings.

The method for forming a latent image on an overcoat layer to which the present invention is applied is a method wherein, in the event of layering an overcoat layer with a dye sublimation thermal transfer method on a surface such as an image recording medium and so forth on which a color image or the like is formed, the applied energy from a thermal head is modulated to cause a surface brilliance difference (contrast) on the overcoat layer to occur, whereby a line pattern is formed with such contrast, and a latent image is formed with the line pattern.

Figure 1:
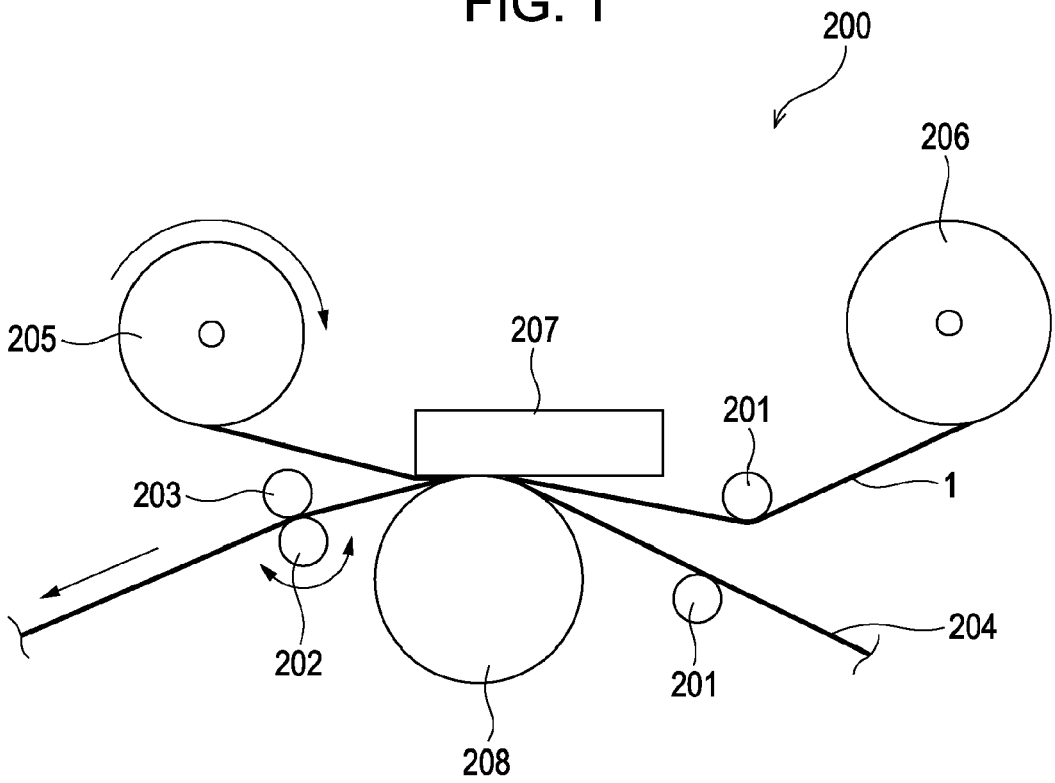
FIG. 1 is a diagram of a printer device to which the present invention is applied.

First, a thermal transfer type printer device 200 which forms a latent image will be described. As shown in FIG. 1, the printer device 200 guides an image recording medium 204 serving as a thermal transfer subject sheet such as printing paper or the like with a guide roller 201, which is then sandwiched with a capstan roller 202 and pinch roller 203 and run.

Figure 2:
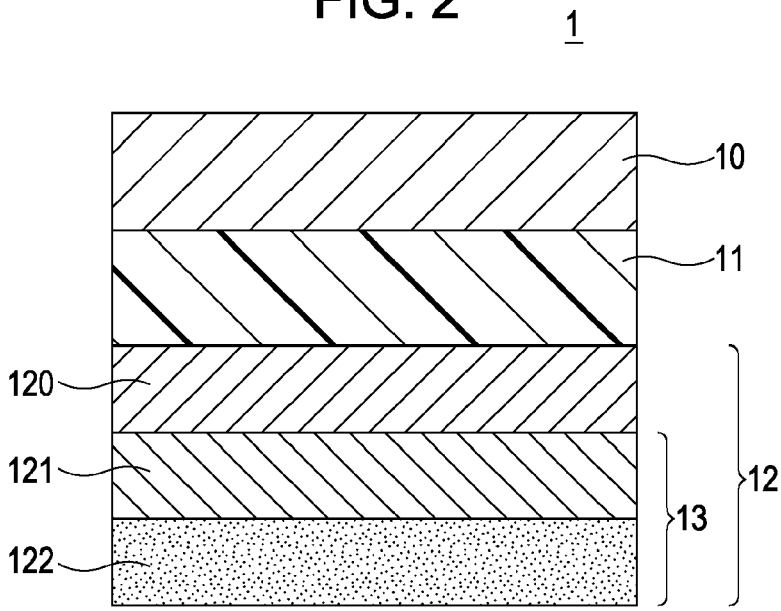
FIG. 2 is a cross-sectional view of a heat transfer sheet to which the present invention is applied.
Figure 3:
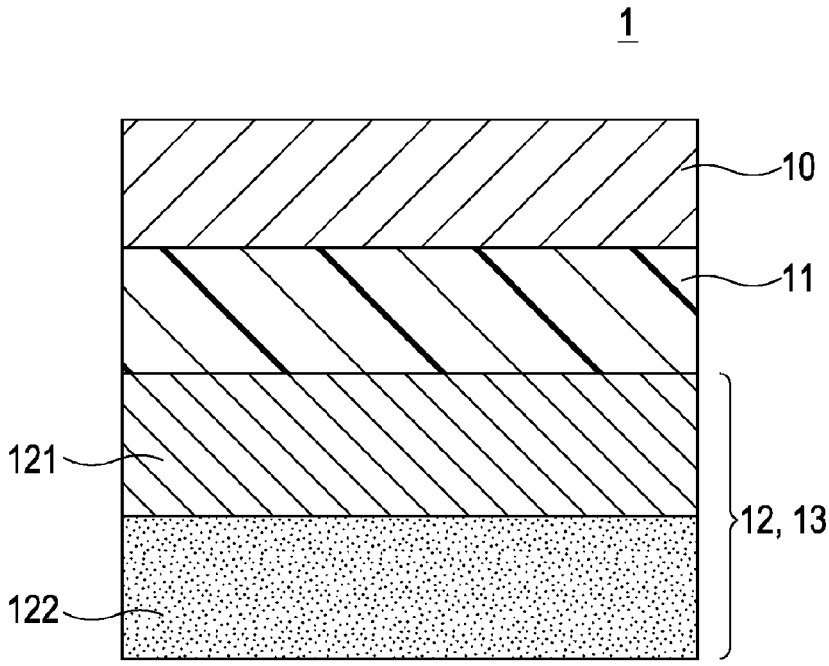
FIG. 3 is a cross-sectional view of a heat transfer sheet to which the present invention is applied.
Figure 4:
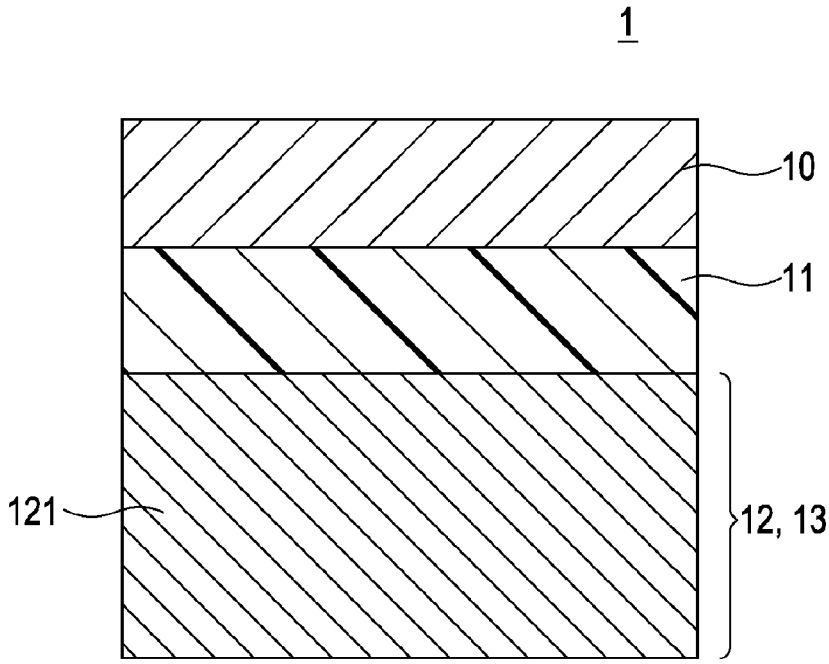
FIG. 4 is a cross-sectional view of a heat transfer sheet to which the present invention is applied.
Figure 5:
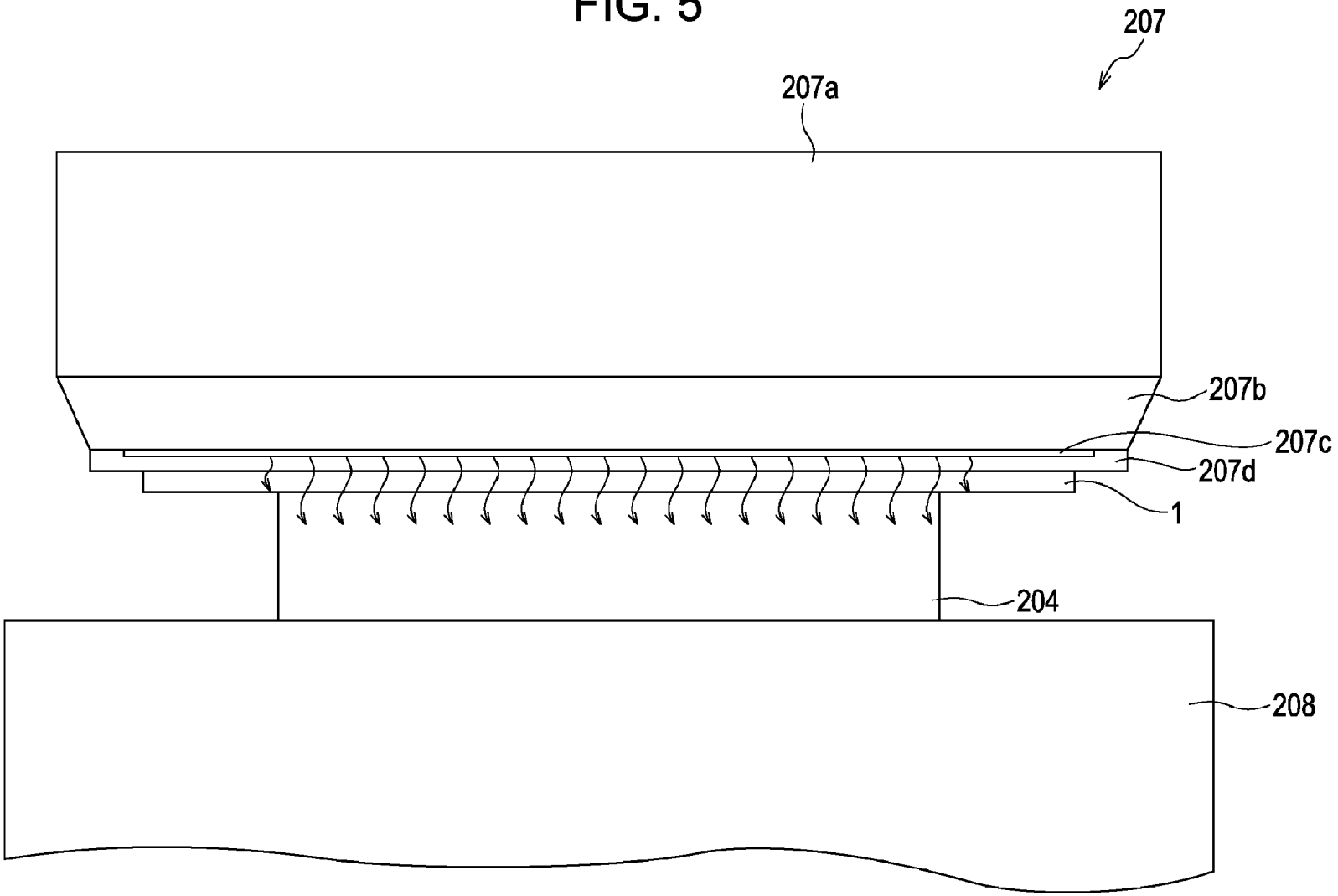
FIG. 5 is a front view of a thermal head of the printer device to which the present invention is applied.

Also, the printer device 200 has a cartridge mounted thereupon which stores a thermal transfer sheet 1 having an overcoat layer 13 to be described in detail later as shown in FIGS. 2 through 4, and the winding reel 205 is rotationally driven, whereby the heat transfer sheet 1 is run from a supply reel 206 to the winding reel 205. A thermal head 207 and platen roller 208 are disposed so as to face one another at the transfer position to transfer the overcoat layer 13 of the thermal transfer sheet 1 to the image recording medium 204. The printer device 200 heats the thermal transfer sheet 1 with the thermal head 207, while pressing on the image recording medium 204 with a predetermined pressure, whereby the overcoat layer 13 is thermally transferred to the image recording medium 204.

To describe the image recording medium 204, the image recording medium 204 is formed such that a dye transferred from the thermal transfer sheet 1 is received on one face of a substrate formed with paper (pulp), propylene (PP), polyethylene terephthalate (PET) or the like, and a receiving layer to hold the received dye is formed. With the image recording medium 204, an image is formed by holding the dye with the receiving layer, and an overcoat layer 13 is layered upon the receiving layer. The receiving layer is formed with a thermoplastic resin such as an acrylic resin, polyester, polycarbonate, or polyvinyl chloride and so forth. Also, on the other face of the substrate has a back layer formed to decrease friction between the guide roller 201 and platen roller 208.

The thermal transfer sheet 1 is made up of a heat resistant lubricating layer 10, substrate 11, and transfer layer 12, as shown in FIGS. 2 through 4. Note that although the details are not shown, the thermal transfer sheet 1 is formed with a color material (formed with a color material such as a dye or . . . and a thermoplastic resin, and has hues such as yellow, magenta, cyan, and black) to form an image, and with the color material layer and transfer layer 12 as a pair, the pair is formed sequentially in the lengthwise direction in facial order. Note that black is formed as needed. With the color material layer, heat energy according to the image data to be printed is applied with the thermal head 207, whereby color material is thermally transferred to the receiving layer of the image recording medium 204. Note that only the transfer layer 12 is provided on the thermal transfer sheet 1, and a color material layer is not necessarily provided.

The heat resistant lubricating layer 10 protects the substrate 11 from instantaneous heat of the thermal head 207, and runs the thermal transfer sheet 1 smoothly. The substrate 11 holds the heat resistant lubricating layer 10 and transfer layer 12.

All or a portion of the transfer layer 12 is thermally transferred and layered on the image formed on the image recording medium 204 as an overcoat layer 13. The transfer layer 12 includes a protecting layer 121 to protect the surface of the image after transfer onto the image. The transfer layer 12 may be provided optionally and include an adhesive layer 122 to adhesively transfer on the image or a non-transferring peeling layer 120 to increase the capacity for the protecting later 121 to be peeled from the substrate 11 side. Also, in the case that the transfer layer 12 is made up from only a protecting layer 121, the protecting layer 121 also serves the function as the adhesive layer 122 at the same time. At the time of transferring the overcoat layer 13, in the case of providing a non-transfer peeling layer 120, the border face between the non-transfer peeling layer 120 adjacent to the substrate 11 side of the protect layer 121 of the transfer layer 12 and the protect layer 121 becomes the peeling face, and in the case that a non-transfer peeling layer 120 is not provided, the border face between the substrate 11 and protect layer 121 becomes the peeling face, the overcoat layer 13 is peeled away from the non-transfer peeling layer 120 or substrate 11, and the overcoat layer 13 is thermally transferred onto the image and layered thereupon.

Specifically, FIG. 2 shows a thermal transfer sheet 1 made up of layers in the order from the side closer to the substrate 11 side of a non-transfer peeling layer 120, protect layer 121, and adhesive layer 122. With the heat transfer sheet 1, in the case that the overcoat layer 13 layered on the image recording medium 204 is transferred onto an image recording medium 2, the layering is configured in the order from the surface side of the image recording medium 2 of an adhesive layer 122 and protect layer 121. With the thermal transfer sheet 1, in the event of thermally transferring the overcoat layer 13 on an image, the border face between the non-transfer reeling layer 120 and the protect layer 121 becomes the peeling face, the protect layer 121 peels away from the non-transfer peeling layer 120, and the overcoat layer 13 made up of the protect layer 121 and adhesive layer 122 is thermally transferred onto the image.

FIG. 3 shows a thermal transfer sheet 1 made by layering a protect layer 121 and adhesive layer 122 in that order from the side closer to the substrate 11, serving as the transfer layer 12. With the thermal transfer sheet 1, in the case that the overcoat layer 13 which is layered on the image recording medium 204 is transferred onto the image recording medium 2, similar to the thermal transfer sheet 1 shown in FIG. 2, the thermal transfer sheet 1 is made by layering the adhesive layer 122 and protect layer 121 in that order from the surface side of the image recording medium 2. With the thermal transfer sheet 1, in the event that the overcoat layer 13 is thermally transferred onto an image, the border face between the substrate 11 and protect layer 121 becomes the peeling face, the protect layer 121 is peeled away from the substrate 11, the overcoat layer 13 made up of the protect layer 121 and adhesive layer 122 is thermally transferred onto the image.

FIG. 4 shows a thermal transfer sheet 1 made only from the protect layer 121 serving as the transfer layer 12. With the thermal transfer sheet 1, the overcoat layer 13 layered on the image recording medium 204 is made only from the protect layer 121, and the protect layer 121 also serves the function of an adhesive layer. With the thermal transfer sheet 1, in the event of thermally transferring the overcoat layer 13 onto the image, the border face between the substrate 11 and protect layer 121 becomes the peeling face, the protect layer 121 is peeled away from the substrate 11, and the overcoat layer 13 made from the protect layer 121 is thermally transferred onto the image.

A material to be used for the substrate 11 of the thermal transfer sheet 1 should have a certain amount of heat resistance and strength, and material according to related art such as various types of processed paper, polyester film, polystyrene film, polypropylene file, polysulfone film, polycarbonate film, polyvinyl alcohol film, polyimide film, polyamide-imide film, polyether ether ketone film, cellophane, and so forth are desirable. The thickness of the substrate 11 should be 0.5 to 50 μm, and is desirable to be at 3 to 15 μm.

A non-transferring peeling layer 120 can be optionally included in the transfer layer 12, and is formed to improve the capability for the overcoat layer 13 which includes the protect layer 121 to peel away from the substrate 11 side in the event of a thermo-sensitive transfer. The non-transferring peeling layer 120 itself is not transferred to the image recording medium 204 as the overcoat layer 13, and remains on the substrate 11 side. The non-transferring peeling layer 120 may be any type that has a function to improve detachability from the protect layer 121. For example, a configuration made up of a detachable resin (silicone resin, fluorine resin, and so forth) or a configuration including a detaching added agent (silicone additive, fluorine additive, long-chain alkyl additive and so forth) to each type of resin, or a configuration made up only of a resign with low compatibility so as to enable detaching from the protect layer 121, may be used.

Forming the protect layer 121 and adhesive layer 122 which make up the overcoat layer 13 with a resin having transparency is desirable, particularly such that observation of the image is not influenced. With the image forming with the dye sublimation thermal transfer method, the resin of the protect layer 121 and adhesive layer 122 enable improved image preserving such as light resistance, heat resistance, ozone resistance, and chemical resistance. The types of resin to use are not particularly restricted, but it is desirable for example that a glass transition point is above ordinary temperature.

A condition of the protect layer 121 is the ability to peel away between the substrate 11 or a layer positioned adjacent to the substrate 11 side, i.e. the non-transferring peeling layer 120, under heat, at the time of thermo-sensitive transfer, having.

The adhesive layer 122 can be optionally included in the transfer layer 12. The adhesive layer 122 has a function to discover thermal adhering as to the image recording medium 204 at the time of thermo-sensitive transfer. As long as the adhesive layer 122 has thermal adhering properties there are no particular constraints; the adhesive layer 122 is selected as appropriate from various resins with consideration for image preservation.

The protect layer 121 and adhesive layer 122 can include an image preserving improvement agent (ultraviolet absorbing agent, antioxidant, or light stabilizer such as HALS) or another additive (fluorescent whitening agent or the like). Note that examples disclosed in Japanese Unexamined Patent Application Publication No. 04-142987 can be given as an image preserving improvement agent or fluorescent whitening agent).

The overcoat layer 13 made from the protect layer 121 and adhesive layer 122 of any state can be used as long as a surface brilliance difference (contrast) can be formed at the time of layering on the image recording medium 204. The key factor of the surface brilliance difference (contrast) is a surface smoothness difference of the surface of the overcoat layer 13 which occurs by an applied energy difference of the thermal head 207, but a height difference (irregularity of approximately 0.1 mm to 10 mm) occurring at the same time by the same energy difference can also be a contributor thereto.

Next, the thermal head 207 which transfers the overcoat layer 13 to the image recording medium 204 will be described. The thermal head 207 is a thermal head having a thermal element 207*c* made up of heat resistors or the like provided linearly via a glaze layer 207*b* on a ceramic base 207*a*, wherein a protective layer 207*d* to protect the thermal element 207*c* is provided on the upper layer thereof. The ceramic base 207*a* is highly exoergic and has a function to prevent heat accumulation from the thermal element 207*c*. Also, the glaze layer 207*b* causes the thermal element 207*c* to abut against the image recording medium 204 and thermal transfer sheet 1, whereby the thermal element 207*c* protrudes against the image recording medium 204 and thermal transfer sheet 1, and also becomes a buffer layer such that the heat of the thermal element 207*c* is not overly absorbed by the ceramic base 207*a*. The thermal head 207 heats, with the thermal element 207*c*, the overcoat layer 13 of the thermal transfer sheet 1 which exists between the image recording medium 204 one line at a time, and transfers the overcoat layer 13 to the image recording medium 204.

Next, a circuit configuration of the printer device 200 configured as described above will be described. The printer device 200 is connected to an interface 209 to which image data for a color image or the like to be printed and latent image data of characters or the like to be a latent image is input (hereafter, simply called interface), an image memory 210 which accumulates image data and latent image data input with the interface 209, a control memory 211 wherein a control program or the like is stored, a control unit 212 which controls operations for the entire thermal head 207 and so forth, via a bus 213. Also, this bus 213 is connected to a capstan roller 202 which runs the image recording medium 204 from the sheet supply unit to the discharge unit and an image recording medium transporting unit 214 having a motor or the like serving as a driving source of the capstan roller 202, the winding reel 205 which runs the thermal transfer sheet 1 and the sheet running unit 215 having a motor or the like serving as a driving source of the winding reel 205 and a thermal head 207, and the image recording transporting unit 214, sheet running unit 215, and thermal head 207 are also controlled with the control unit 212.

The interface 209 is connected to electrical devices such as a display device such as an LCD (Liquid Crystal Display), CRT (Cathode Ray Tube) or the like which displays image data to be printed and latent image data to be formed, and a recording and/or reproducing device or the like whereupon a recording medium is mounted. For example, when a moving image is displayed on the display device, the still image data selected by the user is input. Also, with the interface 209, when the recording and/or reproducing device is connected, still image data recorded on the recording medium such as an optical disk, IC card, and so forth is input. Note that the electrical devices are connected with to the interface 209 by a cable or wirelessly based on the standards such as USB (Universal Serial Bus), IEEE (the Institute of Electrical and Electronic Engineers) 1394, Bluetooth (registered trademark) and so forth.

The image memory 210 has capacity capable of storing at least one sheet worth of each of image data and latent image data, and the image data to be printed and latent image data input with the interface 209 is input and temporarily stored.

Figure 7A:
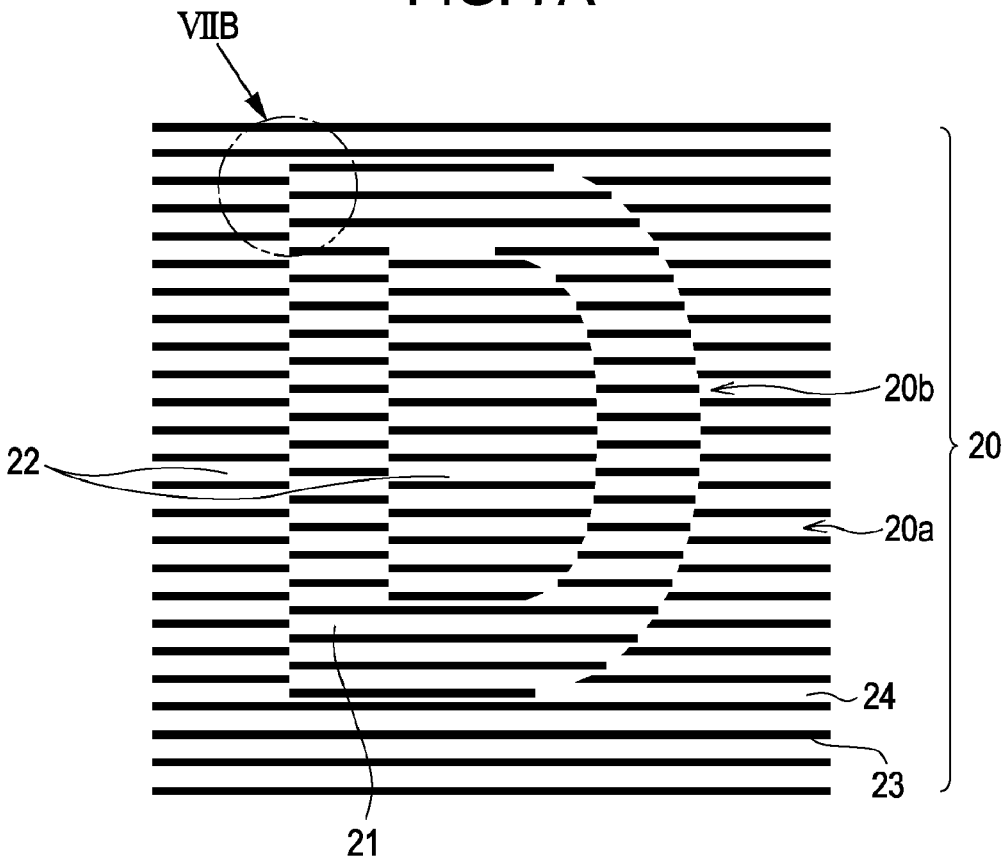
FIG. 7A is a plan view of a latent image portion to which the present invention is applied.
Figure 7B:
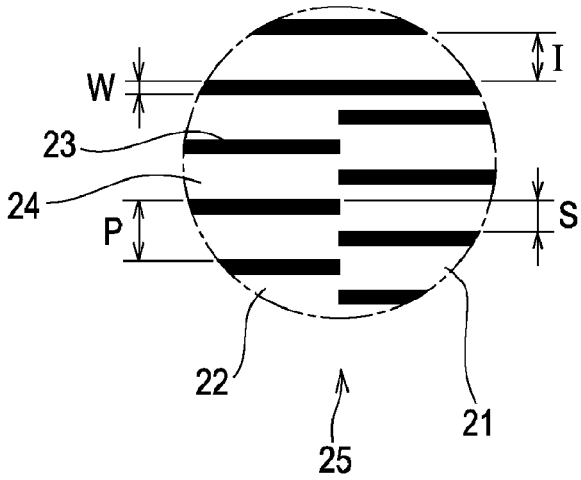
FIG. 7B is a partial enlarged view of a latent image portion.

The control memory 211 has a control program or the like stored therein to control the operations of the entire printer device 200. Also, the control memory 211 has data stored therein of line pattern 20 such as the pitch p of the line 23 forming the line pattern 20 to be described in detail later as shown in FIGS. 7A and 7B and so forth, and also has a program stored therein which causes a phase shift to the line pattern 20 in the event that latent image data is input, according to the input latent image data. The control unit 212 controls overall operations based on the control program stored in the control memory 211.

With a printer device 200 configured as described above, the control unit 212 controls the image recording medium transporting unit 214 to drive according to the program controlling the entire operations stored in the control memory 211, and transports the starting position of the image recording medium 204 to start image forming until the position of the thermal head 207. Also, the control unit 212 controls the sheet running unit 215 to drive such that color material layers of yellow, magenta, cyan, and black of the thermal transfer sheet 1, and the overcoat layer 13, are thermally transferred to the transported image recording medium 204 in this order, and rotationally drives the winding reel 205 to run the thermal transfer sheet 1 to the winding reel 205 side. The control unit 212 rotationally drives the capstan roller 202 and runs the image recording medium 204 to the capstan roller 202 side, while drives the thermal head 207 according to the image data to be printed, and thermally transfers the yellow color material in a density according to the image data. Upon thermally transferring the yellow color material, the capstan roller 202 is rotatably driven to the guide roller 201 side, and runs the image recording medium 204 to the guide roller 201 side until the starting position to start image forming of the image recording medium 204 faces the thermal head 207. The magenta color material is then thermally transferred to the image recording medium 204 whereupon yellow has been thermally transferred, at a density according to the image data, and the image recording medium 204 is again run until the starting position of the image recording medium 204 faces the thermal head 207, and similarly, the remaining color material is thermally transferred to the image recording medium 204 to form the color image.

Next, in order to layer the overcoat layer 13 over the entire image formed beforehand, the control unit 212 rotationally drives the capstan roller 202 to the guide roller 201 side, runs the image recording medium 204 to the guide roller 201 side so that the starting position of the image recording medium 204 faces the thermal head 207, rotationally drives the capstan roller 202 again in the opposite side from the guide roller 201 side, the drives the thermal head 207 according to latent image data while running the image recording medium 204, and thermally transfers the overcoat layer 13 onto the image. In this event, the control unit 212 controls the applied energy as to the overcoat layer 13 of the thermal head 207 so as to form the line pattern 20 from surface brilliance difference onto the surface of the transferred overcoat layer 13 according to latent image data stored in the control memory 211, and forms the latent image portion 21 and background portion 22 on the overcoat layer 13 as shown in FIG. 7A.

Figure 6:
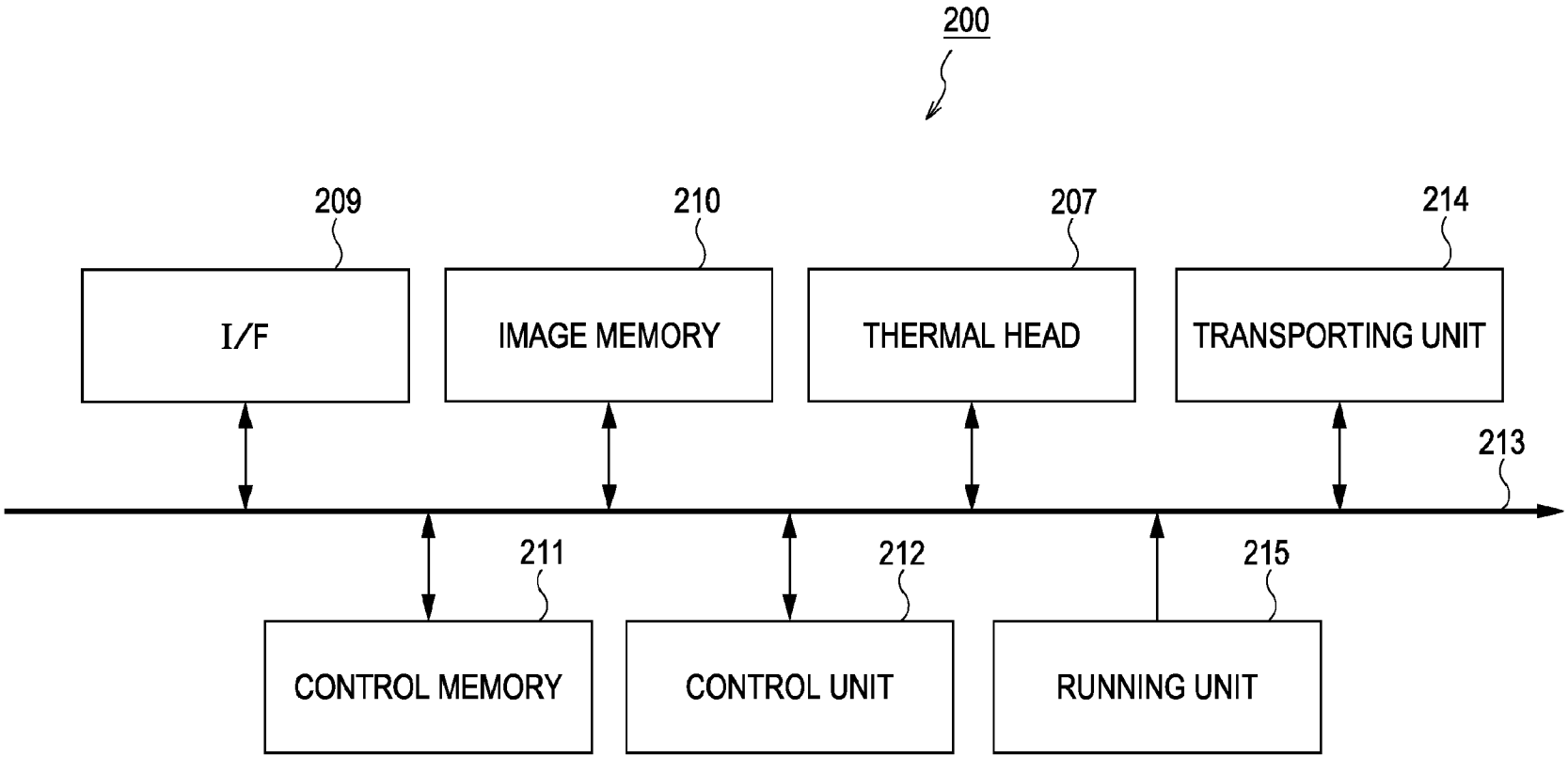
FIG. 6 is a block diagram of a printer device to which the present invention is applied.

With the printer device 200, in the event of layering the overcoat layer 13 on the surface of the image recording medium 204 with the thermo-sensitive transfer method, the applied energy of the thermal head 207 is modulated by the control unit 212 based on latent image data whereby surface brilliance difference is made to occur on the surface of the overcoat layer 13, and by the contrast thereof, as shown in FIGS. 7A and 7B, the line pattern 20 and the latent image portion 21 wherein the latent image is formed by the line pattern 20 are formed. The latent image portion 21 is formed with a line pattern 20*b* having similar pitch p as the line pattern 20*a* of the background portion 22 and having the phase thereof shifted. The background portion 22 is the portion excluding the latent image portion 21. Also, the latent image portion 21 may be text or marks, numbers, symbols, and so forth, and is not particularly restricted. The latent image data forming the latent image portion 21 is input from a keyboard or the like connected to the interface 209 shown in FIG. 6.

Next, a method for forming the line pattern 20 on the surface of the overcoat layer 13 with a surface brilliance difference (contrast difference) in the event of layering the overcoat layer 13 on the image recording medium 204 with the printer device 200 will be described.

The control unit 212 controls the increase/decrease of applied energy of the thermal head 207 according to the latent image data and line pattern 20 data. Thus, with the printer device 200, the brilliance of the surface of the overcoat layer 13 after layering can be changed. The ability to change the brilliance on the surface of the overcoat layer 13 with this method is as described in Japanese Unexamined Patent Application Publication 3-159795.

Following this principle, in the event of layer the overcoat layer on the image recording medium 204 with thermal transferring, by performing thermal energy increasing/decreasing under control of the control unit 212 of the printer device 200 by, a line pattern 20 from surface brilliance difference is formed on the overcoat layer 13 after layering, as shown in FIG. 7A, whereby the latent image portion 21 and background portion 22 can be formed. With the latent image portion 21 and background portion 22, lines 23 are formed in a low brilliance region formed by high thermal energy being applied from the thermal head 207, and a line base 24 is formed in a high brilliance region formed by low thermal energy being applied from the thermal head 207. Note that an arrangement may be made wherein the lines 23 are formed in the high brilliance region and the line base 24 is formed in the low brilliance region to form the line pattern 20. The line base 24 is a region between the lines 23. In the case of observing the image recording medium 204, the latent image portion 21 cannot be visually confirmed from a position directly facing the image. The latent image portion 21 can be visualized by layering a visualizing tool 30 with light transparency at a particular angle and particular distance, and observing from a particular angle.

Such a latent image forming method is a method generally called line moiré, whereby for example a latent image is formed with a printed image, the latent image thereof is visually confirmed using a visualizing tool, thus enabling authenticity or distinction between an original and copy to be determined. The line moiré is described in Japanese Unexamined Patent Application Publication 2005-43778, for example. According to a method with related art whereby a latent image is embedded within the printed image, an image is obtained which has low visible confirmation of the latent image from any observation angle. However, embedding the latent image in a photographic image is difficult, and a design with high uniformity in density is desired. On the other hand, with the latent image forming method by the printer device 200, the latent image portion 21 is formed on the overcoat layer 13 which is separate from the receiving layer which forms the image, and the line pattern 20 with light transparency forming the latent image portion 21 is formed with a contract of surface reflective light, which is different from the method in the related art. Thus, the latent image portion 21 is arranged so as not to enable being observed from the position directly facing thereto. Also, the latent image unit 21 can be configured to be difficult to visually confirm even in the case of observing by tilting the image recording medium 204 whereupon the overcoat layer 13 is formed. Also, by creatively arranging the processing method for the end portions 23*a* of the lines 23 positioned on the border region 25 of the latent image portion 21 and background portion 22, the latent image portion 21 can be made further difficult to be visually confirmed.

The lines 23 that make up the line pattern 20 are lines which appear as a surface brilliance difference (i.e., contrast) on the overcoat layer 13 having light transparency. In the case of visualizing the latent image portion 21 using the visualizing tool 30, compared to a method with the related art, with the related art method the latent image portion can be visualized by observing from a position directly facing thereto, whereas the latent image portion 21 formed on the overcoat layer 13 with the printer device 200 can be visualized only by observing from a particular angle. This is because the latent image portion 21 is made up of colorless lines 23 formed using surface brilliance difference as opposed to the related art method whereby the latent image is made up of colored lines.

Figure 8:
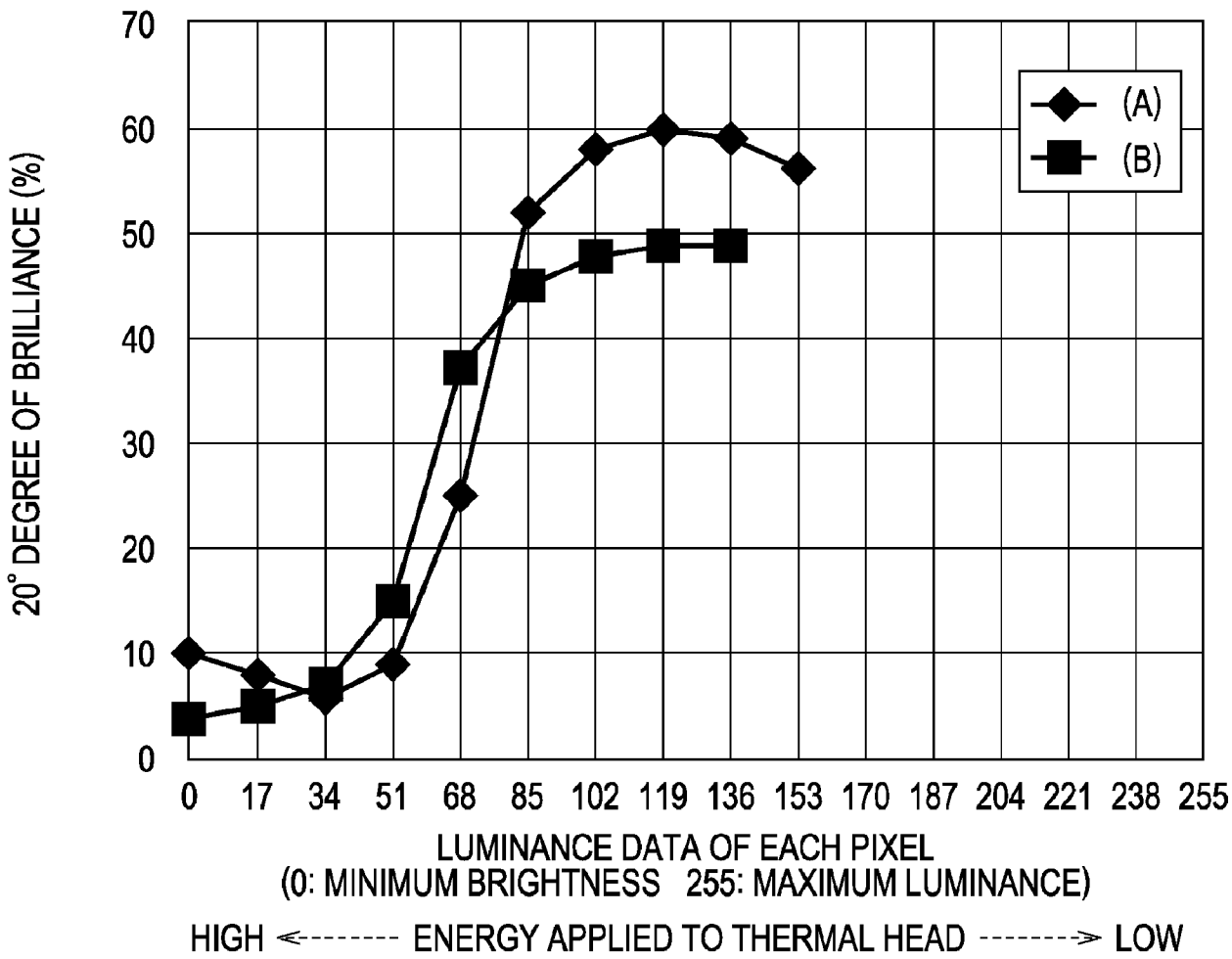
FIG. 8 is a graph illustrating the relation between the applied energy of the thermal head and a 20° degree of brilliance thereof.

The relation between the applied energy of the thermal head 207 at the time of layering the overcoat layer 13 and the 20° specular gloss (JIS Z8741) of the surface of the overcoat layer 13 will be described. FIG. 8 shows a case wherein the applied energy of the thermal head 207 at the time of layering the overcoat layer 13 is changed into 16 types.

In FIG. 8, the horizontal axis shows the highs and lows of the applied energy of the thermal head 207. Here the farther to the left side of the horizontal axis shows higher energy and the farther to the right side shows lower energy. The numerical values shown on the horizontal axis are numerical values of luminance data of the bitmap image data (solid image) used in the event of applying energy. These numerical values are express as 8-bit: 0 (minimum) to 255 (maximum). That is to say, the relation between the luminance data numerical value and the applied energy of the thermal head 207 has maximum applied energy with luminance data 0 and has minimum applied energy with luminance data 255. In FIG. 8, the following 16-point luminance data numerical values are used for 20° brilliance measurement. The 16-point luminance data numerical values are 0, 17, 34, 51, 68, 85, 102, 119, 136, 153, 170, 187, 204, 221, 238, and 255.

In FIG. 8, the vertical axis shows 20° specular gloss (JIS Z8741) of the surface of the overcoat layer 13 with the above-described horizontal axis 16 points. There is a region on the side with a large luminance data numerical value (right side on the horizontal axis) where brilliance is not shown. This is because the overcoat layer 13 could not be layered (thermal transfer adhesive) on the surface of the image recording medium 204 from lack of applied energy. Also, in the case that the type and material of the overcoat layer 13 differs, for example different profiles are obtained as in (A) and (B).

The profile (A) will be described here as an example. For example, two applied energies equating to the luminance data numerical value "119" and luminance data value "0" of the horizontal axis are used to form a portion equating to the lines 23 shown in FIG. 7A and a portion equating to the line base 24, whereby brilliance difference occurs, and a contrast based on such brilliance difference can be obtained. Let us say that a region with relatively high brilliance is a high luminance region (a region formed with luminance data "119" and equating to 20° luminance 60%), and a region with relatively low brilliance is a low luminance region (a region formed with luminance data "0" and equating to 20° luminance 10%). For example, the lines 23 are formed in a low brilliance region, and the line base 24 is formed in a high brilliance region. Note that contrast may be obtained by forming the lines 23 in the high brilliance region and forming the line base 24 in the low brilliance region. Actually, the lines 23 and line base 24 within the line pattern 20 are a micro region, directly measuring the brilliance of each region of the lines 23 and line base 24 independently is difficult in such a micro region. The line pattern 20 only has a width of one element worth (approximately 84.7 mm with 300 dpi) of a thermal element 207 for each line, for example, whereby a measured surface sufficient to measure the 20° brilliance independently for each region cannot be obtained. Accordingly, brilliance means the 20° brilliance in the case of employing the applied energy with a solid image, as shown in FIG. 8.

The line pattern 20 with latent image therein which is formed on the overcoat layer 13 forms a region with a surface brilliance differing from the overcoat layer 13, whereby the one region with differing surface brilliance becomes the lines 23 and the other becomes the line base 24.

The line pattern 20 with latent image therein has the following parameters, as shown in FIG. 7B.

pitch of lines 23 (cycle) (p)

width of lines 23 portion (w)

distance between neighboring lines 23 (l)

phase shifting amount of lines 23 between latent image portion 21 and background portion 22 (necessary for causing contrast to occur between latent image portion 21 and background portion 22 in the event of visualizing. In the case that the phase shift amount of the lines 23 is roughly ½ of the pitch p of the lines 23, the contrast of the latent image portion 21 from the line moiré is at maximum.) (s)

form of lines 23 (solid line, broken line, dotted line and so forth)

set brilliance of lines 23 set brilliance of line base 24 direction of lines 23

The pitch (cycle) of the lines 23 is defined by width w of line 23 portion+distance 1 between neighboring lines 23.

Based on this definition, the pitch (cycle) p of the lines 23 is line width of high brilliance region+line width of low brilliance region.

In the event of forming lines 23 using brilliance difference, which of the high brilliance region and low brilliance region to use for the lines 23 and line base 24 is optional. As is clear from the expression defining the pitch (cycle) p of the lines 23, regardless of the case of forming the lines 23 and line base 24 with which of the high brilliance region and low brilliance region, the pitch (cycle) p of the lines 23 is the same. Also, the form of the lines 23 may be any of solid lines, broken lines, or dotted lines. In the case that both the high brilliance region and low brilliance region are made up of solid lines, regardless of high or low brilliance, either side may be the lines 23 or line base 24. In FIGS. 7A and 7B, the lines 23 are the low brilliance region and the line base 24 is the high brilliance region.

However, from the constraint to form the lines 23 with the thermal head 207 provided on the printer device 200, the width of one element worth of the thermal elements provided on the thermal head 207 becomes the minimum unit to form a line 23. With consideration for the above, it is desirable to set the pitch (cycle) p and phase shift amount s of the lines 23.

With the line pattern 20 with latent image therein, at the time of generating the bitmap image data (latent image data) and/or at the time of forming the line pattern 20 for the overcoat layer, there may be cases in the border region 25 between the latent image portion 21 and background portion 22, between lines 23 of the latent image portion 21 and background portion 22, wherein the outline of the latent image becomes obvious by gaps between mutual lines 23 (regardless of parallel and/or perpendicular direction of lines 23) becoming wider or suddenly narrower (hereafter called "gap unevenness". This gap unevenness prevents the latent image from being difficult to visually confirm, and thus is not desirable. In this case, gap unevenness reducing measures can be taken to cause the gap unevenness to be less obvious.

In the case of the former, i.e. in the event of creating bitmap image data for the line pattern 20 with latent image therein, gap unevenness occurs hear the border region 25 of the latent image portion 21 and background portion 22 depending on the pitch (cycle) p of the lines 23, the width w of the lines 23 portion, and the phase shift amount s of the lines 23. As a measure to be taken in this case, correction processing can be performed by various types of adjusting as to the gap unevenness portions of the bitmap image data. For example, gap unevenness reducing measures can be taken such as the interpolation, thinning, intervals, length (including overlap amount adjustment of the lines 23 for forming the lines 23 and background portion 22 to form the latent image portion 21), and thickness of the lines 23, and brilliance adjustment (adjusting the luminance data of the pixels) within the lines 23 and line base portion 24. Correction processing can be exemplified as follows.

Overlap Amount Adjustment of Lines 23 for Forming Lines 23 and Background Portion 22 to Form Latent Image Portion 21

Figure 9:
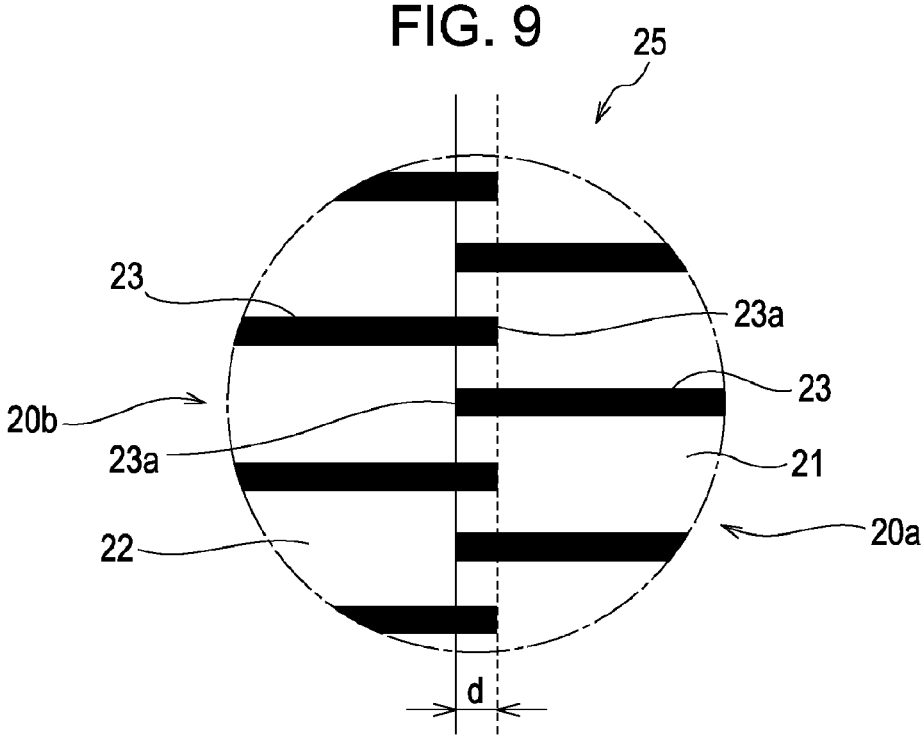
FIG. 9 is a partial plan view illustrating a state of overlapping end portions of lines in the latent image portion and background portions.

For example, in the border region 25 of the latent image portion 21 and background portion 22, the positions of the end portions 23*a* of the lines 23 of the latent image portion 21 and the end portions 23*a* of the lines 23 of the background portion 22 may be aligned, but as shown in FIG. 9, the control unit 212 can perform correction processing for the bitmap image data so that the end portions 23*a* of both lines 23 of the latent image portion 21 and background portion 22 are overlapped. In this event, the overlap amount d can also be adjusted as appropriate.

Brilliance Adjustment Within Lines 23 and Within Line Base Portion 24

Figure 10:
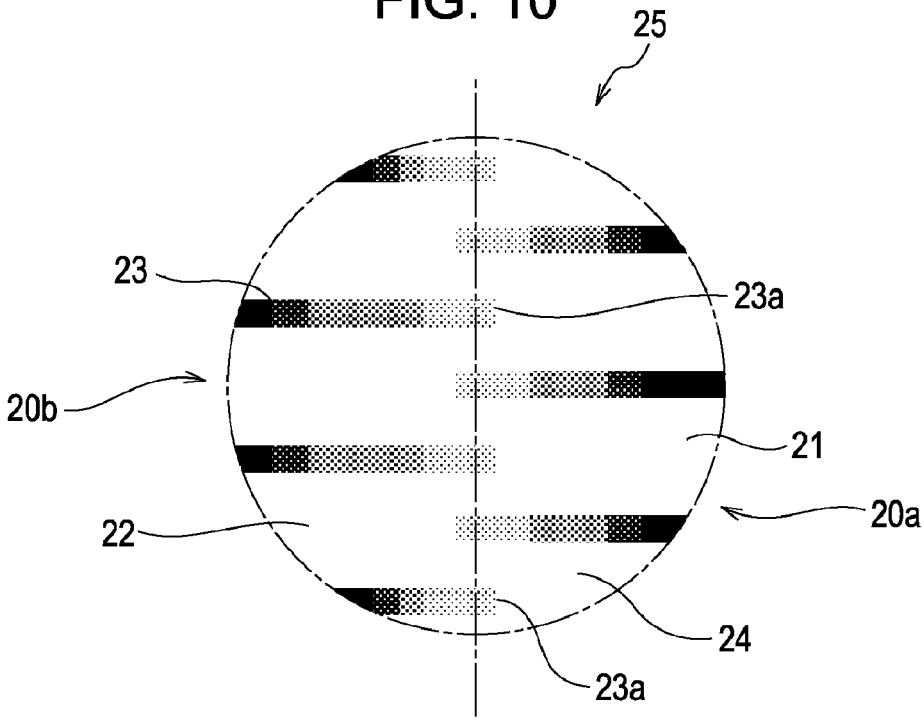
FIG. 10 is a partial plan view illustrating a state of a gradient applied to the end portions of the lines in the latent image portion and background portions.

Also, as a separate example, as shown in FIG. 10, the control unit 212 adjusts the luminance data of the bitmap image data for each line 23 so that the applied energy amount for each line 23 approaches the applied energy amount of the line base 24 as the end portions 23*a* of each line 23 of the latent image portion 21 and background portion 22 is approached at the border region 25 of the latent image portion 21 and background portion 22, enabling the end portions 23*a* of the lines 23 to approach the 20° brilliance of the line base 24.

On the other hand, in the case of the latter, i.e. in the event of forming a line pattern 20 with latent image therein on the overcoat layer 13 with the printer device, a phenomenon may occur in that the line pattern 20 according to the original bitmap image data is not formed (hereafter called "incomplete line forming"). This incomplete line forming occurs near the end portions 23*a* of the lines 23, and is observed as gap unevenness, similar to the time of bitmap image data being generated. The mechanism for the incomplete line forming to occur can be presumed as follows. That is to say, at the time of forming the line pattern 20 for the overcoat layer 13, sufficient thermal energy is not supplied to form a low brilliance region in a segment immediately following the portion wherein the applied energy of the thermal head 207 forming the high brilliance region (hereafter called high brilliance region forming portion) switches to a portion forming the low brilliance region (hereafter called low brilliance region forming portion), and the portions which should be formed as a low brilliance region (e.g. lines 23) continue to be formed as a high brilliance region (e.g. line base portion 24), whereby incomplete line forming occurs. In order to reduce this, so that the low brilliance region can begin to be formed in a region switching from the high brilliance region forming portion of the bitmap image data to the low brilliance region forming portion, the length of the incomplete line forming occurrence region should be estimated from a region farther beforehand, and the control unit 212 can perform correction processing to control the applied energy of the thermal head 207.

Specifically, the control unit 212 references the above-mentioned bitmap image data, and in the case determination is made that there may be incomplete line forming, the control unit 212 controls the driving of the thermal head 207 so as to process the lines 23 hear the border region 25 as appropriate. Thus, the lines 23 near the border region 25 can be processed so as to cause the gap unevenness in the periphery of the latent image portion 21 to be less obvious. Also, this processing may be performed on demand while referencing the bitmap image data as described above, or correction processing may be built in to be performed in the event of processing at the time of bitmap image data generating (correction processing for gap unevenness occurring at the time of bitmap image data creating with latent image therein).

Also, in the event of forming the lines 23, it is desirable for the control unit 212 to control the applied energy of the thermal head 207 so that the high brilliance region has a 20° brilliance of 30% or greater and the low brilliance region has a 20° brilliance of less than 30% in order to obtain a favorable contrast, and further, it is desirable to control the applied energy such that the high brilliance region has a 20° brilliance of 40% or greater and the low brilliance region has a 20° brilliance of less than 20%.

Also, generally, for a photographic image, a higher surface brilliance tends to be desired. In the case of increasing the surface brilliance of a printed image 40, the control unit 212 controls the thermal head 207 so as to form the lines 23 such that the width of the high brilliance region/width of the low brilliance region≧1, thereby enabling a higher surface brilliance. As described above, which region to assign to the lines 23 or line base 24 is optional.

Further, it is desirable for the pitch (cycle) p of the lines 23 to be 700 μm or less. Greater than 700 μm would cause the line pattern 20 to become obvious on the image, and even if processing is performed on the lines 23 in the border region 25 between the latent image portion 21 and background portion 22, the latent image portion 21 becomes obvious. A more desirable line pitch p is 500 μm or less.

Figure 11:
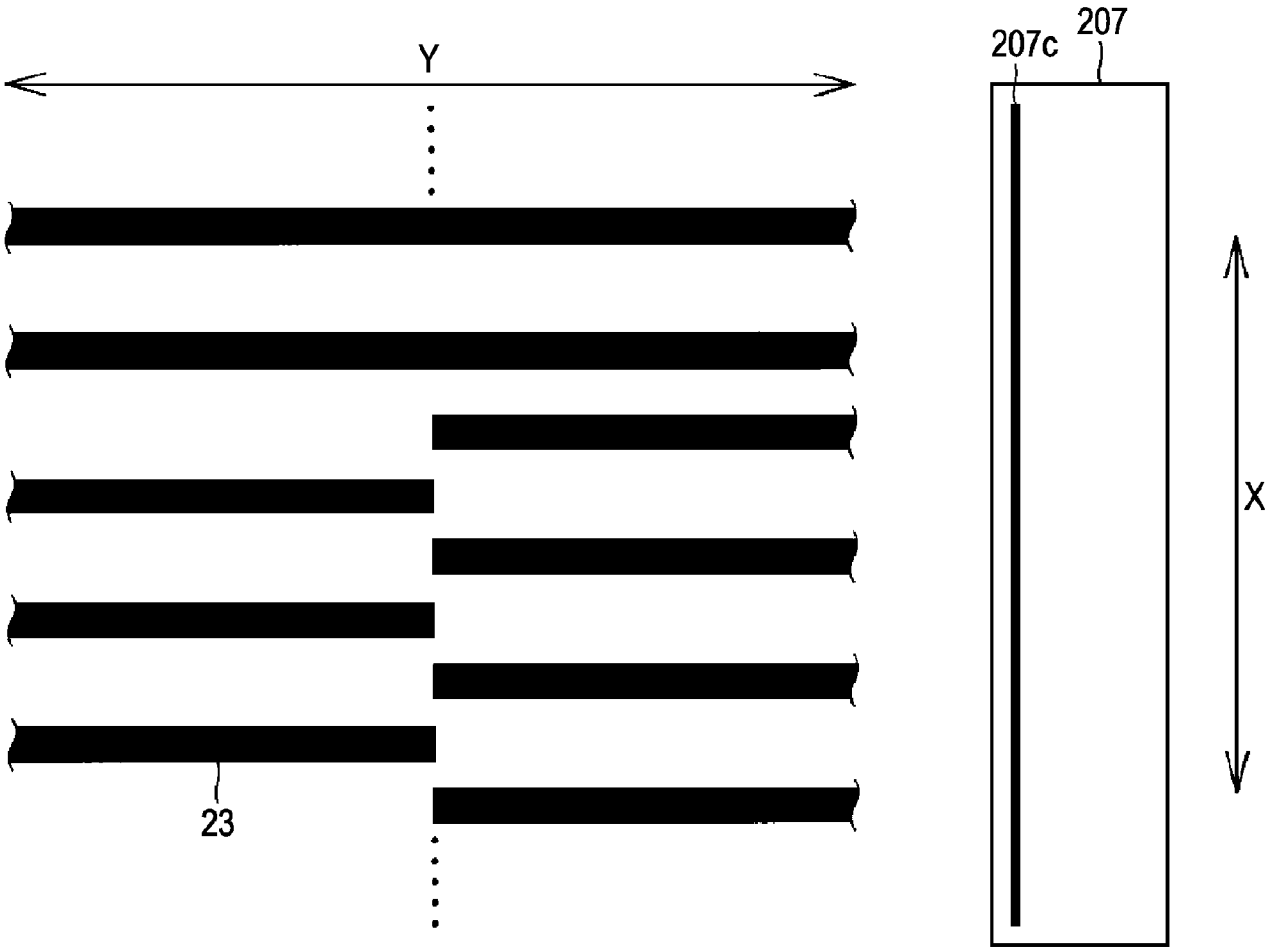
FIG. 11 is a plan view illustrating the relation between the direction of lines and the thermal head.

Also, the minimum pitch p of the lines 23 is the length of two elements worth of the thermal elements 207*c* provided on the thermal head 207. In the case that the primary scanning direction resolution of the thermal head 207 is 300 dpi, the pitch p is roughly 169.3 μm, and in the case of 600 dpi, the pitch p is roughly 84.7 μm. Also, in the case of attempting to obtain a favorable brilliance difference (contrast) between the lines 23 and line base 24, it is desirable for the control unit 212 to set the direction of the forming lines 23 to be set so as to run perpendicular to or parallel to the primary scanning direction X, as shown in FIG. 11. In particular, if the running direction of the lines 23 is the perpendicular direction as to the primary scanning direction X, i.e. a vertical scanning direction Y, a favorable contrast is readily obtained. Note that the primary scanning direction X is the direction wherein the thermal elements 207*c* are arrayed in a line, and the vertical scanning direction Y is the transporting direction of the image recording medium 204.

Note that by adjusting an average brilliance for the face to be the background of the image surface, the latent image portion 21 and the perimeter thereof may be provided with an edging pattern portion having a phase shifted from that of the latent image portion 21, for example, as described in Japanese Unexamined Patent application Publication No. 10-100529 with printing.

Further, the line pattern 20 is formed in the primary scanning direction X of the thermal head 207, the line pattern 20 is formed also in the vertical scanning direction Y, and the line patterns 20 in the primary scanning direction X and vertical scanning direction Y are layered, whereby the latent image portion 21 can be provided on each of the primary scanning direction X and vertical scanning direction Y. Also, the data of the line patterns 20 for obtaining the brilliance difference stored in the control memory 211 is not necessarily binary data. Also, in order to increase control, adding a fluorescent whitening agent or ultraviolet absorbing agent independently or as a combination thereof to the overcoat layer 13.

Thus, based on control by the control unit 212, in order to visualize the latent image portion 21 on the overcoat layer 13 formed with the printer device 200 as a line moiré, the latent image portion 21 should be observed by using a visualizing tool 30 having lines (unshown) of a similar pitch p to the lines 23 used at the time of forming the latent image so that the line directions mutually roughly match.

The visualizing tool 30 has a supporting portion 31 to support a printed item 40, a visualizing portion 32 attached at a predetermined angle (elevation angle θ to be described later) on one edge of the supporting portion 31, and a connecting portion 33 to connect the supporting portion 31 and visualizing portion 32. The supporting portion 31 supports the printed item in a flat manner, so is formed in a board shape.

The visualizing portion 32 has a light transparent substrate 34 attached to the frame as a transparent substrate. The light transparent substrate 34 is formed by the lines 34*a* being printed of roughly the same pitch p as the lines 23 of the latent image portion 21 formed on the image of the printed item 40. Any type of transparent substrate may be used so long as the material has light transparency, but polyester film is particularly desirable.

The lines 34*a* are formed by using the above-described printer device 200 used for image forming to print the lines 23 of similar pitch p as the lines 23 of the latent image portion 21 on the light transparent substrate 34 on which a dye receiving layer is formed. Thus, the lines 34*a* of the visualizing tool 30 can be readily created by using the printer device 200 used for image forming.

Figure 13:
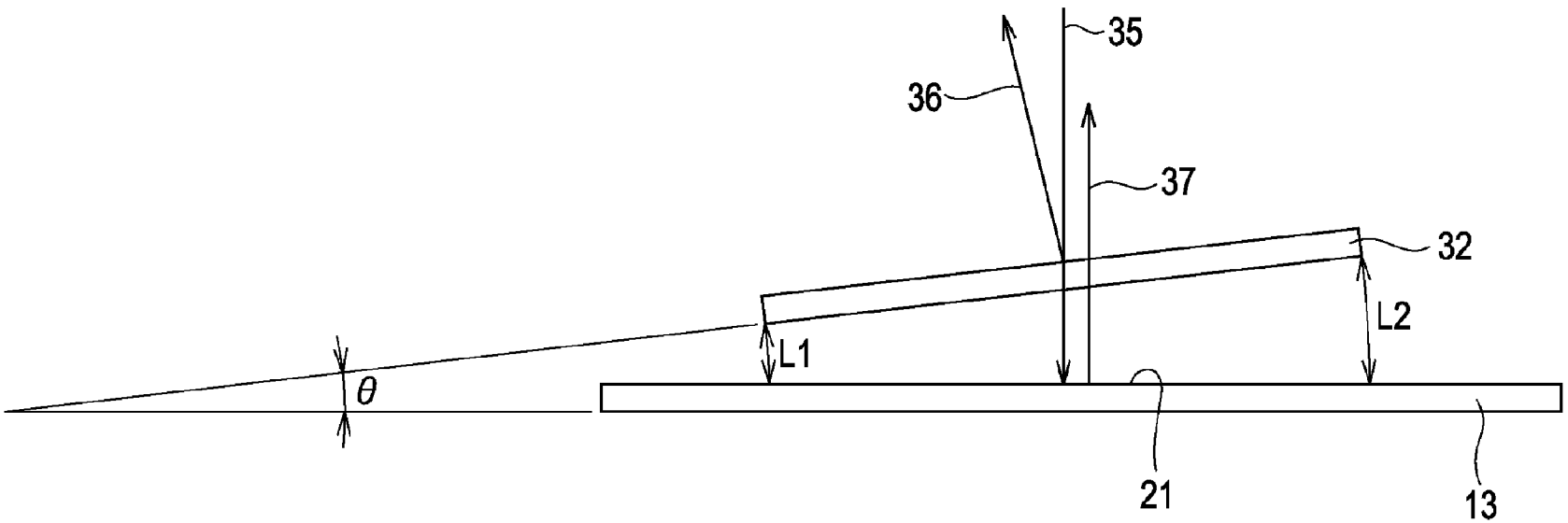
FIG. 13 is a side view illustrating the positional relation between an overcoat layer and visualizing tool.

The visualizing portion 32 is attached to the supporting portion 31 via the connecting portion 33, as shown in FIG. 13, so that the visualizing portion 32 is not parallel with the supporting portion 31, but the angle formed by mounting the printed item 40 of the supporting portion 31 and the face of the supporting portion 31 becomes an elevated angle θ.

In the event of mounting the printed item on the supporting portion 31 and observing the latent image portion 21, the printed item 40 is movable in the direction orthogonal to the lines 34*a*, whereby a opening portion 33*a* through which the printed item 40 is inserted is formed.

With such a visualizing tool 30, by mounting the printed item 40 on the supporting portion 31, as shown in FIG. 13, the angle formed between the overcoat layer 13 of the printed item 40 and the visualizing portion 32 becomes an elevated angle θ.

Note that a visualizing tool to be employed in the event of visualizing the latent image portion 21 is not restricted to the above-described visualizing tool, as long as the lines 23 with a similar pitch p as the lines 23 of the latent image portion 21 are formed on the transparent substrate.

It is desirable for the visualizing tool 30 to tilt the visualizing portion 32, having a distance L1 between the face of the visualizing portion 32 side of the overcoat layer 13 and the end portion of the connecting portion 33 side of the visualizing portion 32, and a distance L2 between the face of the visualizing portion 32 side of the overcoat layer 13 and the end portion at the opposite side from the connecting portion 33 side of the visualizing portion 32, so that the angle formed between the overcoat layer 13 of the printed item 40 and the visualizing portion becomes an elevated angle θ appropriate for observing the latent image portion 21. L1 and L2 depend also on size of the visualizing tool 30, but are distances whereby an optimal elevated angle θ can be obtained, and are in the range of 0.5 mm to several tens of mm, preferably 1 mm to 10 mm, such that L1<L2.

The reason for having an optimal elevated angle θ is as follows. In the case of not having an elevated angle θ, the face of the visualizing portion 32 of the visualizing tool and the face of the overcoat layer 13 become parallel, whereby the reflected light 36 from the visualizing portion of incident light 35 input perpendicularly as to the latent image portion 21 and the reflected light 37 from the overcoat layer 13 reach the observer simultaneously. At this time, the specular reflection optic element 36 obstructs the observation of the reflective optic element 37 from the overcoat layer 13 including the brilliance difference contrast, resulting in the line moiré not being able to be clearly observed. In order to avoid this situation, as shown in FIG. 13, the visualizing tool 30 has an elevated angle θ and the advancing direction of reflected light 36 and 37 are mutually different, whereby the specular reflection optic element 36 from the surface of the visualizing portion 32 is shifted, and only the reflected light element 37 from the overcoat later 13 can be observed. Thus, the contrast occurring from the brilliance difference in the event of measuring the reflected light element 37 of the overcoat layer 13, i.e. the latent image portion 21, can be more clearly observed by an observer.

Figure 12:
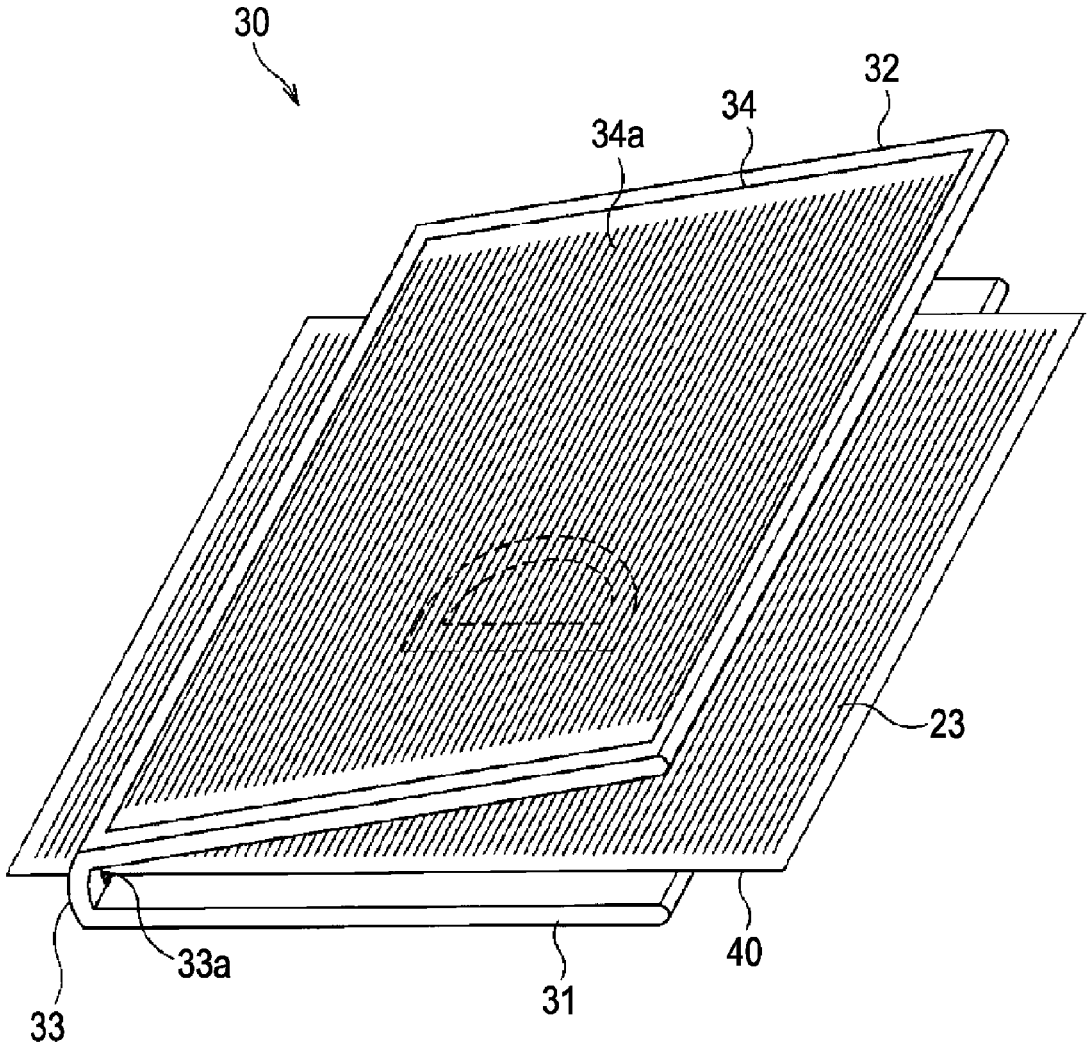
FIG. 12 is a perspective view of a visualizing tool.

Thus, the latent image portion 21 formed with the printer device 200 is difficult to be visually confirmed from a position directly facing the image of the printed item 40, and can be visualized by observing through the visualizing tool 30 shown in FIGS. 12 and 13. The visualizing of the latent image portion 21 is moiré which occurs by the line image from the surface brilliance difference (contrast) occurring in the event that the light irradiated on the overcoat layer 13 layered on the surface of the printed item 40 is reflected, and the lines 34*a* of the visualizing tool 30 are interpolated, and can be observed with specified reflection conditions are fulfilled.

As described above, with the latent image forming method with the printer device 200, in the event of layering a transparent overcoat layer 13 on an image formed with a dye or the like, the applied energy from the thermal head 207 is modulated for each heat element 207*c* for example, whereby surface brilliance difference occurs on the surface of the overcoat layer 13, and with such contrast, a line pattern 20 is formed as shown in FIGS. 7A and 7B, the line pattern 20*b* of the latent image portion 21 and the line pattern 20*a* of the background portion 22 are formed with similar pitch p, and are formed with a shifted phase, whereby a latent image portion 21 can be formed which is difficult to visually confirm from the position directly facing the image of the printed item 40, and a latent image portion 21 can be formed which cannot be visually confirmed without using the visualizing tool 30.

Also, the printed item 40 obtained with the latent image forming method has a configuration wherein the latent image portion 21 is formed on the overcoat layer 13 layered on the image of the printed item 40, and the receiving layer on which the image is formed is independent from the overcoat layer 13 on which the latent image portion 21 is formed, and thereby is released from a constraint resulting from both co-existing on the same layer. That is to say, the latent image portion 21 can be embedded directly on top of the image even if the image is a full-color image such as a photograph, without losing the design of the image. Thus, with the latent image forming method employing the printer device 200, a photographic printed item can be obtained which has high design freedom as well as security.

Also, with this printer device 200, the latent image (line drawing) can be formed on the overcoat layer 13 at the same time as layering the overcoat layer 13 on the image, enabling readily forming a printed item 40 with latent image therein more than with the related art. The overcoat layer 13 and lines 23 are both light transparent, and do not prevent observation of the recording image positioned under the overcoat layer 13.

Embodiments

The latent image forming method and visualizing method of the latent image to which an embodiment of the present invention is applied will be described below.

First Embodiment

With the first embodiment, a latent image is formed on the visualizing tool and overcoat layer.

(1) Manufacturing the Visualizing Tool

A receiving layer is provided on a transparent PET (thickness of 125 μm), and black lines are printed with a dye sublimation thermal transfer type printer UP-CR10L (manufactured by Sony Corp., thermal head resolution 300 dpi, width of one thermal head is approximately 84.7 μm). Bitmap image data is used for the printing. The set image resolution is set as 300 dpi, and one pixel of the image data is set to correspond to one thermal element of the thermal head. The manufacturing conditions of the line data are as below.

Manufacturing Conditions of Line Data line pitch=4 pixels width of line portion=2 pixels distance between lines=2 pixels line direction=perpendicular as to main scanning direction of thermal head line shape=solid line A transparent film upon which a line pattern with such conditions is printed is the visualizing tool. Note that a 2UPC-C14 print pack thermal transfer sheet of (manufactured by Sony) is used for the line printing.

(2) Forming Line Pattern With Latent Image Therein on Overcoat Layer

Using the 2UPC-C14 print pack (manufactured by Sony), first, a solid gray print is made without an overcoat layer. Following this, the overcoat layer is layered over the solid gray image. In this case, the energy amount applied with the thermal transfer is changed and causes brilliance difference on the surface of the overcoat layer, whereby a line pattern with latent image therein is formed by such contrast. The line pattern with latent image therein is prepared as bitmap image data. To create the bitmap image data for forming a line pattern with latent image therein, bitmap image editing software (Product name Photoshop, by Adobe Systems) is used.

Specifically, first, line image data of the background portion (4×6 inches) is created with the sequence below.

The image resolution is set to 300 dpi, and bitmap image data is newly created of 4 inches (300×4=1200 pixels) in the primary scanning direction of the thermal head of the printer device, and 6 inches (300×6=1800 pixels) in the vertical scanning direction.

A line pattern to serve as the background portion is written into this region with the conditions below. With the present embodiment, the low brilliance region formed at the time of overcoat layer transfer is assigned as the lines portion and the high brilliance region is assigned as the base portion.

Conditions of Line Pattern for Background Portion line pitch=4 pixels width of line portion=1 pixel distance between lines (line base)=3 pixels line form=solid line luminance data of line portion pixels=luminance data equating to 20° brilliance 20% luminance data of line base portion pixels=luminance data equating to 20° brilliance 60% line direction=vertical direction as to the primary scanning direction of the thermal head (i.e. vertical scanning direction)

The luminance data numerical values for the pixels of each of the line portion and line base portion are determined by referencing luminance data numerical values whereby an overcoat layer region of the print pack (2UPC-14) used with the present embodiment is used to create profile for 20° brilliance as to the luminance data numerical value, as shown in FIG. 8, and desired brilliance can be obtained.

Next, line data with latent image therein is embedded within the above-mentioned background portion. The data serving as a latent image portion is created as shown below.

The new image data made up of 100 pixels×100 pixels (resolution set at 96 dpi) is created. As shown in FIG. 7A, a character "D" is formed in this region, with the upper case letter "D" having the features of font: HGSoeiKakugothicUB, font size: 72 points, input "without antialiasing", height of 77 pixels and width of 62 pixels. According to the present embodiment, the character "D" becomes the latent image.

Further, a line pattern similar to the line pattern of the background portion created beforehand (the outside portion of the character "D") is formed on the character "D" forming portion and the background portion (inside portion of the character "D") within the 100 pixels×100 pixels bitmap image data.

At this time, the phase of each line pattern for the latent image portion and background portion (inside portion of the character "D") are shifted and formed. The line pattern phase shift amount of the latent image portion and background portion is ¼ (shift worth 1 pixel).

The data with latent image therein which is thus obtained is pasted onto the line image data of the background portion created beforehand (the outside portion of the character "D") so that the phase of the background portion (the inside portion of the character "D") matches thereto, whereby the bitmap image data for forming the line pattern with latent image therein is obtained.

(3) Layering the Overcoat Layer with Latent Image Therein on the Image

The created bitmap image data for forming a line pattern with latent image therein is transferred to the UP-CR10L, and using the overcoat layer transfer region of the print pack (2UPC-C14 made by Sony) for the same printer, the overcoat layer with latent image therein is layered onto the above-described solid gray printed item. The image data resolution at the time of image data transfer is set to the same thermal head resolution (here, 300 dpi) as the printer being used, wherein 1 pixel of the image data corresponds to one element worth of heating elements. In this event, bitmap image data processing is performed near the edge portions as appropriate, so that the edge portions of the character of the latent image portion "D" cannot easily be visually confirmed by the naked eye after transferring the overcoat layer. Regarding the pixel data near the edge portion of the "D" within the bitmap image, overlap amount adjusting between the lines of both the latent image portion and background portion and gradation adjusting of luminance data is performed. Specifically, with the bitmap image data, the overlap amount is adjusted so that the overlap amount of the lines of both the latent image portion and background portion becomes 4 pixels, and the gradation of the luminance data is adjusted so that 4 pixels worth of the ends of both lines become the brilliance shown in Table 1. Note that the overlap amount extends the lines of the latent image portion, and of the lines of the upper and lower overlapping background portion, the overlapping amount with the lines having less overlap amount becomes 4 pixels.

(4) Visualizing the Latent Image

A visualizing tool manufactured as described above is layered on the printed item on which the overcoat layer with embedded latent image portion, and the printed item is observed with the line directions of both being roughly parallel, whereby contrast occurs between regions of the latent image portion "D" and the background portion thereof by line moiré, and the latent image portion "D" is visualized. Also, by slightly moving the visualizing tool in a direction vertical to the latent image line direction, visualizing a latent image portion wherein the contrast between the latent image portion and background portion are reversed can be observed. Also similarly, regarding an image using a natural image instead of the above-mentioned solid gray image, an overcoat layer having a similar latent image portion is formed, and the same latent image portion "D" character could be visualized.

Second Through Eleventh Embodiments

With the second through eleventh embodiments, the line forming conditions for the overcoat layer and visualizing tool according to the first embodiment are changed as described in Table 1 and Table 2 below, but otherwise similar to the first embodiment the visualizing tool is created, the latent image is formed by the overcoat layer layering, and confirmation is made as to whether or not the latent image portion can be visualized, whereby in each case, visualizing the latent image similar to the first embodiment can be observed.

TABLE 1

| | Conditions for forming lines on overcoat layer and visualizing tool | | | | | |
|---|---|---|---|---|---|---|
| | | Forming lines with latent image therein for overcoat layer | | | | |
| | Parameter format at time of forming lines A B C D-E F G-H | Line pitch (latent image and background) (μm) = 1000 × 25.4 × A/H | Line portion (low brilliance region) Form | Line portion (low brilliance region) Set brilliance (20°) (%) | Line base portion (high brilliance region) Set brilliance (20°) (%) | Set brilliance of 4 pixels worth of both ends of latent image portion and background portion at time of performing line end processing (4 pixels worth of overlapping and degradation) Set brilliance (20°) (%) I-J-K-L |
| Embodiment 1 | 4 1 3 1-4 2 2-3 0 0 | 338.7 | Solid line | 20 | 60 | 20-20-40-40 |
| Embodiment 2 | 4 1 3 2-4 2 2-3 0 0 | 338.7 | Solid line | 20 | 60 | 20-20-20-40 |
| Embodiment 3 | 4 1 3 2-4 2 2-3 0 0 | 338.7 | Solid line | 5 | 40 | 5-5-10-30 |
| Embodiment 4 | 4 1 3 2-4 2 2-3 0 0 | 338.7 | Broken line Line portion length 3 pixels Blank portion length 1 pixel | 20 | 60 | 20-20-20-40 |
| Embodiment 5 | 4 1 3 2-4 2 2-3 3 4 | 304.2 | Solid line | 10 | 70 | 10-10-40-60 |
| Embodiment 6 | 4 2 2 2-4 2 2-3 0 0 | 338.7 | Solid line | 20 | 60 | 20-30-40-40 |
| Embodiment 7 | 4 2 2 2-4 2 2-3 0 0 | 338.7 | Solid line | 5 | 60 | 5-10-30-50 |
| Embodiment 8 | 4 2 2 2-4 2 2-3 0 0 | 338.7 | Dotted line Line portion length 2 pixels Blank portion length 2 pixels | 5 | 60 | End processing not performed |
| Embodiment 9 | 4 3 1 2-4 2 2-3 0 0 | 338.7 | Solid line | 20 | 60 | End processing not performed |
| Embodiment 10 | 6 2 4 3-6 2 4-3 0 0 | 508.0 | Solid line | 20 | 60 | 20-20-20-40 |
| Embodiment 11 | 8 2 6 4-8 2 6-3 0 0 | 667.3 | Solid line | 20 | 60 | 20-20-20-40 |

TABLE 2

| | Conditions for forming lines on overcoat layer and visualizing tool | | | | | |
|---|---|---|---|---|---|---|
| | Forming lines with latent image therein for overcoat layer | | Forming lines for visualizing tool | | | |
| | Line direction To primary scanning direction of thermal head | Line phase shift amount Phase = D/A | Line pitch (μm) = 1000 × 25.4 × E/H | Printer used to form lines | Printer pack used to form lines | Latent image can be visualized with visualizing tool |
| Embodiment 1 | Vertical | ¼ | 338.7 | UP-CR10L | 2UPC-14 | Yes |
| Embodiment 2 | Vertical | ½ | 338.7 | UP-CR10L | 2UPC-14 | Yes |
| Embodiment 3 | Vertical | ½ | 338.7 | UP-CR10L | 2UPC-14 | Yes |
| Embodiment 4 | Vertical | ½ | 338.7 | UP-CR10L | 2UPC-14 | Yes |
| Embodiment 5 | Vertical | ½ | 304.2 | UP-DR150/4 | 2UPC-R154H | Yes |
| Embodiment 6 | Vertical | ½ | 338.7 | UP-CR10L | 2UPC-14 | Yes |
| Embodiment 7 | Parallel | ½ | 338.7 | UP-CR10L | 2UPC-14 | Yes |

TABLE 2-continued

| | Conditions for forming lines on overcoat layer and visualizing tool | | | | | |
|---|---|---|---|---|---|---|
| | Forming lines with latent image therein for overcoat layer | | Forming lines for visualizing tool | | | |
| | Line direction To primary scanning direction of thermal head | Line phase shift amount Phase = D/A | Line pitch (μm) = 1000 × 25.4 × E/H | Printer used to form lines | Printer pack used to form lines | Latent image can be visualized with visualizing tool |
| Embodiment 8 | Vertical and parallel | ½ (both line directions) | 338.7 | UP-CR10L | 2UPC-14 | Yes |
| Embodiment 9 | Vertical | ½ | 338.7 | UP-CR10L | 2UPC-14 | Yes |
| Embodiment 10 | Vertical | ½ | 508.0 | UP-CR10L | 2UPC-14 | Yes |
| Embodiment 11 | Vertical | ½ | 667.3 | UP-CR10L | 2UPC-14 | Yes |

The format ABCD-EFG-H of the parameters at the time of forming the lines, as shown in Tables 1 and 2, is as described below.

(Parameters at Time of Forming Lines for Overcoat Layer)

A: pitch of lines (=B+C)

B: width of line portion

C: distance between lines (line base portion)

D: line pattern phase shift amount between latent image portion and background portion (latent image−background)

(Parameters at Time of Forming Lines for Visualizing Tool)

E: pitch of lines (=F+G)

F: width of line portion

G: distance between lines (Resolution)

H: resolution of thermal head on printer (same for resolution of line forming image data)

Note that the units for A through G are by pixel (1 digit each), 1 pixel is worth one element of a heating element, and the H unit is dpi (3 digits).

In Table 1, the set brilliance of the line portion and line base portion of the overcoat layer uses the luminance data numerical value obtained by the 20° brilliance set for each embodiment in the print pack to be used.

In Table 2, the line form of the line forming conditions for the visualizing tool is a solid line for first through third embodiments, fifth through seventh embodiments, and ninth through eleventh embodiments, a broken line for the fourth embodiment, and a dotted line for the eighth embodiment, and the line direction is vertical as to the main scanning direction of the thermal head.

Also, the line pitch of the overcoat layer described in Table 1 and the line pitch of the visualizing tool described in Table 2 are theoretical values obtained by parameter formats at the time of forming lines as shown in Table 1, and there may be cases of unevenness from thermal head accuracy and so forth.

Also, in Table 1, with setting the brilliance for 4 pixels worth of the ends of both the latent image portion and background portion at the time of performing line end processing, I-J-K-L are as shown below.

I: fourth pixel from the end

J: third pixel from the end

K: second pixel from the end

L: first pixel from the end

However, with the fourth embodiment, the pixel applicable to the blank portion of the broken line is set as the brilliance of the line base portion.

From the results shown in FIG. 1, by forming the low brilliance region and high brilliance region to output surface brilliance difference on the overcoat layer, the line pattern is formed, and by shifting the phase of the line pattern of the latent image portion and the line pattern of the background portion, in the case of viewing the line pattern without using the visualizing tool, the latent image portion "D" cannot be visually confirmed, and it becomes clear that visual confirmation can only be made in the case of observing via the visualizing tool.

Also, with the first through eighth embodiments and the tenth and eleventh embodiments, the width of the line base portion formed in the high brilliance region is a width greater than the line portion formed in the low brilliance region, whereby the brilliance of the overall printed item is improved than the ninth embodiment wherein the width of the line base portion is narrower than the width of the line portion.

Also, with the second through eleventh embodiments, the phase shift amount of the lines is ½, having a higher contrast of the latent image portion "D" than the first embodiment having a phase shift amount of ¼, whereby the latent image portion "D" can be clearly confirmed.

Also, regardless of whether the lines are formed with any form of solid lines, broken lines, or dotted lines, the direction of the lines is placed in the vertical or parallel direction to the primary scanning direction of the thermal head, or the lines are formed to be vertical and parallel to the thermal head, and these are layered, in the case of viewing without using the visualizing tool, similarly the latent image portion "D" cannot be visually confirmed, and visual confirmation can only be made in the case of observing via the visualizing tool.

It should be understood by those skilled in the art that various modifications, combinations, sub-combinations and alterations may occur depending on design requirements and other factors insofar as they are within the scope of the appended claims or the equivalents thereof.

What is claimed is:

1. A heat transfer method for forming a latent image on an overcoat layer when the overcoat layer is deposited on a thermal transfer sheet, said method comprising the steps of:

setting a thermal head with at least two different types of applied energy;

forming a pattern via the thermal head, the pattern comprising a plurality of lines consisting of high brilliance portions and a low brilliance portions; and forming the latent image within the pattern by shifting a phase of a portion of the plurality of lines which form the pattern, wherein a background image excludes the latent image.

2. The method according to claim 1, wherein the plurality of lines are perpendicular or parallel to a main scanning direction of the thermal head.

3. The method according to claim 1, wherein the plurality of lines are solid lines, broken lines, and/or dotted lines.

4. The method according to claim 1, wherein the width of each of the high brilliance portions is equal to or greater than the width of each of the low brilliance portions.

5. The method according to claim 1, wherein the ends of the plurality of lines forming the latent image and the ends of the plurality of lines forming the background overlap.

6. The method according to claim 1, wherein the difference between the high brilliance portions and low brilliance portions is reduced where the ends of the plurality of lines forming the latent image meet the ends of the plurality of lines forming the background.

7. The method according to claim 1, wherein the phase shift is the size of one-half or less of the width of one of the lines and the width of the space between two lines.

8. A visualizing method to visualize the latent image according to claim 1, comprising the steps of:

using a visualizing tool configured to form a line pattern having the same pitch as the latent image; and observing the latent image as a line moiré.

9. A latent image portion visualizing method according to claim 8, wherein said transparent substrate of said visualizing tool is disposed at a slope as to a face forming said latent image portion of said overcoat layer.

10. A visualizing jig configured to visualize the latent image portion on said overcoat layer formed with the latent image forming method to the overcoat layer according to claim 1, wherein a line pattern having the same pitch as said line pattern formed on said overcoat layer is formed on the transparent substrate.

* * * * *